United States Patent [19]

Dellinger

[11] Patent Number: 4,697,651

[45] Date of Patent: Oct. 6, 1987

[54] METHOD OF DRILLING DEVIATED WELLBORES

[75] Inventor: Thomas B. Dellinger, Duncanville, Tex.

[73] Assignee: Mobil Oil Corporation, New York, N.Y.

[21] Appl. No.: 944,737

[22] Filed: Dec. 22, 1986

[51] Int. Cl.[4] ..... E21B 7/08

[52] U.S. Cl. ..... 175/61; 175/76; 175/94

[58] Field of Search ..... 175/61, 62, 73, 75, 175/76, 94, 101, 107

[56] References Cited

U.S. PATENT DOCUMENTS

| | | | |
|---|---|---|---|
| 3,587,757 | 6/1971 | Herring | 175/94 |
| 4,212,359 | 7/1980 | Adcock | 175/94 |
| 4,246,975 | 1/1981 | Dellinger | 175/61 |
| 4,431,068 | 2/1984 | Dellinger et al. | 175/61 |
| 4,577,701 | 3/1986 | Dellinger et al. | 175/61 |

OTHER PUBLICATIONS

W. R. Garrett and H. M. Rollins, Nov. 9, 1964, The Oil and Gas Journal, "New Tool Steers Drill Bit", pp. 194–199.

*Primary Examiner*—Stephen L. Novosad
*Assistant Examiner*—Terry Lee Melius
*Attorney, Agent, or Firm*—Alexander J. McKillop; Michael G. Gilman; George W. Hager, Jr.

[57] ABSTRACT

Directional drilling is carried out with a rotary drilling tool having a drill string, a drill bit, a drill motor for rotating the drill bit independently of the drill string, an extension sub having both axially contracted and axially extended positions for providing weight to the drill bit when moving from a contracted to an extended position so as to effect a drilling stroke by the drill bit into the wellbore bottom when drilling with the drill bit independently of rotation of the drill string, and a measuring-while-drilling unit acting in conjunction with spiral-bladed stabilizers for effecting proper orientation of the drill bit prior to each drilling stroke.

10 Claims, 3 Drawing Figures

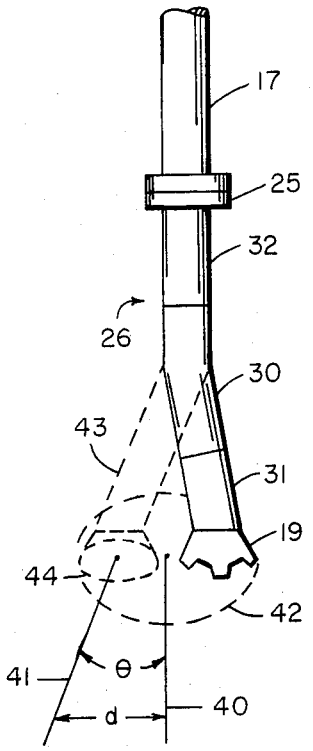
FIG. 2
PRIOR ART
FIG. 3
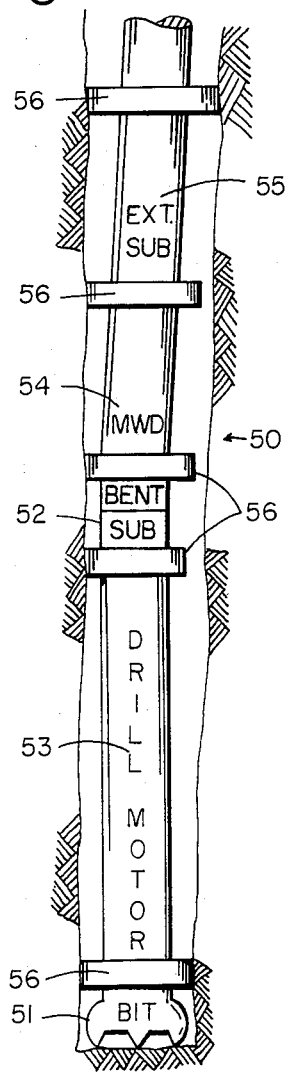

METHOD OF DRILLING DEVIATED WELLBORES

BACKGROUND OF THE INVENTION

The present invention relates to rotary drilling and, more particularly, to a directional drilling technique for providing deviated wellbores at significantly greater inclinations and/or over horizontal distances substantially greater than that currently being achieved by conventional directional drilling practices. The success of such directional drilling should benefit mainly offshore drilling projects as platform costs are a major factor in most offshore production operations. Wellbores with large inclination or horizontal distance offer significant potential for (1) developing offshore reservoirs not otherwise considered to be economical, (2) tapping sections of reservoirs presently considered beyond economical or technological reach, (3) accelerating production by longer intervals in the producing formation due to the high angle holes, (4) requiring fewer platforms to develop large reservoirs, (5) providing an alternative for some subsea completions, and (6) drilling under shipping fairways or to other areas presently unreachable.

A number of problems are presented by high angle directional drilling. In greater particularity, wellbore inclinations of 60° or greater, combined with long sections of wellbore or complex wellbore profiles, present significant problems which need to be overcome. The force of gravity, coefficients of friction, and mud particle settling are the major physical phenomena of concern.

In the rotary drilling of a highly deviated wellbore into the earth, a drill string comprised of drill collars and drill pipe is used to advance a drill bit attached to the drill string into the earth to form the wellbore. As the inclination of the wellbore increases, the desired weight-on-bit for effective drilling from the drill string decreases as the cosine of the inclination angle, and the weight of the drill string lying against the low side of the wellbore increases as the sine of the inclination angle. The force resisting the movement of the drill string along the inclined wellbore is the product of the apparent coefficient of friction and the sum of the forces pressing the string against the wellbore wall. At an apparent coefficient of friction of approximately 0.58 for a common water base mud, drill strings tend to slide into the wellbore from the force of gravity at inclination angles up to approximately 60°. At higher inclination angles, the drill strings will not lower from the force of gravity alone, and must be mechanically pushed or pulled, or alternatively, the coefficients of friction can be reduced.

SUMMARY OF THE INVENTION

In accordance with the present invention, there is provided a method and system for drilling a deviated wellbore into the earth by rotary drilling wherein a drill string is used to advance a drill bit through the earth and a drilling fluid is circulated down the drill tool and returned from the wellbore in the annulus formed about the drill tool.

A vertical first portion of the wellbore is drilled into the earth from a surface location to a kick-off point by rotating and advancing the drill tool and drill bit into the earth. A deviated second portion is initiated at the kick-off point and is drilled by a drill tool comprised of a drill string, having affixed to its lower end a bottom-hole assembly including a drill bit, a drill motor for rotating the drill bit independently of the drill string, a bent sub directing the axis of rotation of the drill bit such that it is angularly displaced from the axis of the drill string, an orientation device for sensing the rotation of the bottom-hole assembly, and an extension sub having both contracted and extended positions for providing weight to the drill bit during movement from its contracted to its extended position.

The drill tool is positioned so that the drill bit is a predetermined distance above the wellbore bottom. A rapid dynamic movement downward is imparted to the drill tool along with rotation, so that the drill bit impacts the wellbore bottom and places the extension sub in its contracted position. The drill tool is raised so that the drill bit is no longer in contact with the wellbore bottom. The bottom-hole assembly is rotated so that the axis of rotation of the drill bit is at a desired angular orientation with respect to the axis of the drill string. A drilling stroke of the drill bit into the earth below the wellbore bottom is then carried out by simultaneously maintaining the drill string stationary, rotating the drill bit under control of the drill motor, and advancing the drill bit under the weight provided by the extension sub in moving from its contracted position to its extended position. Upon completion of the drilling stroke, the drill tool is raised so as to again position the drill bit at the predetermined distance above the wellbore bottom. A new drilling stroke is then initiated.

The imparting of downward movement to the drill tool to place the extension sub in the contracted position includes the high-speed rotation of the drill string, in the order of 150 revolutions per minute, to take advantage of the compound coefficient of friction principle and the rapid lowering of the drill tool from a distance of about 30 feet above the wellbore bottom. A desired initial weight-on-bit is at least 20,000 pounds when the extension sub is stroked from its contracted position and at least 16,000 pounds when in its fully extended position.

The rotation of the bottom-hole assembly is carried out by means of the movement of spiral-bladed stabilizers against the wellbore wall as the drill tool is raised to move the drill bit out of contact with the wellbore bottom. In one aspect the drill string may be rotated along with the bottom-hole assembly. In another aspect the bottom-hole assembly may rotate independently of the drill string by means of a ratchet which affixes the bottom-hole assembly to the drill string.

BRIEF DESCRIPTION OF THE DRAWINGS

FIGS. 2 and 3 are more detailed schematic drawings of the lower portion of the rotary drilling tool of FIG. 1.

DESCRIPTION OF THE PREFERRED EMBODIMENT

Figure 1:
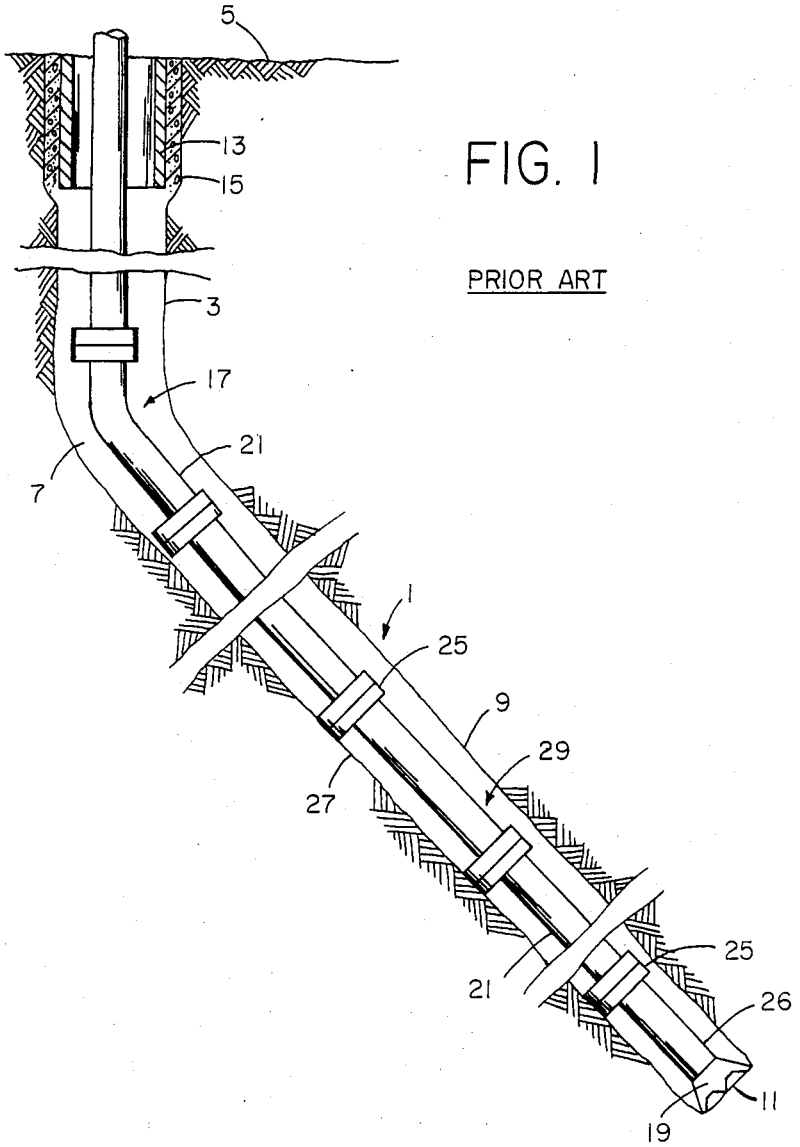
FIG. 1 PRIOR ART
FIG. 1 is a schematic drawing of a deviated wellbore extending into the earth and illustrates one embodiment of a rotary drilling tool utilized in the present invention.

This invention is directed to a rotary drilling technique for drilling a deviated wellbore into the earth and, more particularly, to a method and apparatus for supplying a desired weight-on-bit and bit orientation for the effective drilling of the deviated wellbore.

In rotary drilling operations, a drill string is employed which is comprised of drill pipe, drill collars, and a drill bit. The drill pipe is made up of a series of joints of seamless pipe interconnected by connectors known as tool joints. The drill pipe serves to transmit rotary torque and drilling mud from a drilling rig to the bit and to form a tensile member to pull the drill string from the wellbore. In normal operations, the drill pipe is always in tension during drilling operations. Drill pipe commonly varies from 3½" to 5" in outside diameter. Drill collars are thick-walled pipe as compared to drill pipe and thus are heavier per linear foot than drill pipe. The drill collars act as stiff members of the drill string. The drill collars are normally installed in the drill string immediately above the bit and serve to supply weight on the bit.

In carrying out rotary drilling techniques, a drilling rig is employed which utilizes a rotary table for applying torque to the top of the drill string to rotate the drill pipe and the drill bit. The rotary drill table also acts as a base stand on which all tubulars, such as drill pipe, drill collars, and casing, are suspended in the wellbore from the rig floor. a kelly is used as a top tubular member in the drill string and the kelly passes through the rotary table and is acted upon by the rotary table to apply the torque through the drill pipe to the drill bit. Mud pumps are used for circulating drilling fluid or mud intermediate the drilling rig and the bottom of the wellbore. Normally, the drilling fluid is pumped down the drill string and out through the drill bit and is returned to the surface through the annulus formed about the drill pipe. The drilling fluid serves such purposes as removing earth cuttings made by the drill bit from the wellbore, cooling the bit, and lubricating the drill pipe to lessen the energy required in rotation. In completing the well, casing is normally run thereinto and is cemented for the purpose of sealing and maintaining the casing in place.

The drilling of a deviated wellbore is illustrated in U.S. Pat. Nos. 4,431,068 and 4,577,701. A vertical first portion of the wellbore is drilled into the earth's crust from a surface location to a kick-off point at about the lower end of the first portion by rotating and advancing a drill string and drill bit into the earth's crust. A deviated second portion of the wellbore is initiated at the kick-off point. Referring more particularly to FIG. 1, there is shown a wellbore 1 having a vertical first portion 3 that extends from the surface 5 of the earth to a kick-off point 7 and a deviated second portion 9 of the wellbore which extends from the kick-off point 7 to the wellbore bottom 11. A shallow or surface casing string 13 is shown in the wellbore surrounded by a cement sheath 15. A drill string 17 is comprised of drill pipe 21, a bottom-hole assembly 26, and a drill bit 19. The drill pipe 21 is comprised of joints of pipe that are interconnected together by either conventional or eccentric tool joints 25, as is also illustrated in U.S. Pat. No. 4,246,975, in the vertical first portion 3 of the wellbore extending in the open hole portion thereof below the casing 13 as well as in the deviated second portion 9 of the wellbore. The tool joints 25 in the deviated second portion 9 of the wellbore rest on the lower side 27 of the wellbore and support the drill pipe 21 above the lower side 27 of the wellbore.

In drilling of the deviated wellbore, drilling fluid (not shown) is circulated down the drill string 17, out of the drill bit 19, and returned via the annulus 29 of the wellbore to the surface 5 of the earth. Drill cuttings formed by the breaking of the earth by the drill bit 19 are carried by the returning drilling fluid in the annulus 29 to the surface of the earth. These drill cuttings (not shown) tend to settle along the lower side 27 of the wellbore about the drill pipe 21. The eccentric tool joints 25 resting on the lower side 27 of the wellbore support the drill pipe 21 above most of these cuttings. During drilling operations, the drill string 17 is rotated and the rotation of the eccentric tool joints 25 causes the drill pipe 21 to be eccentrically moved in the wellbore. This movement of the drill pipe 21 tends to sweep the drill cuttings (not shown) from the lower side of the wellbore 27 into the main stream of flow of the returning drilling fluid in the annulus 29, and in particular into that part of the annulus which lies around the upper side of the drill pipe 21, where they are better carried by the returning drilling fluid to the surface of the earth.

To effect a change in the direction of the deviated portion of the wellbore, the bottom-hole assembly 26 includes a bent-sub 30, a drill motor 31, and a measuring-while-drilling unit 32 as shown in FIG. 2.

Drill bit 19 is rotated by drill motor 31 independently of any rotation of the drill string 17. The bent sub 30 is a section of the drill string that is bent or deviated from the axis of the drill string. In this way, the axis of rotation of the drill bit 19 is angularly displaced from the axis of the rotation of the drill string. Located immediately above bent sub 30 is the measuring-while-drilling system 32. Rotation of both the drill string 17 by a surface located kelly (not shown) and the drill bit 19 by the drill motor 31 effects a generally straight path for the second deviated portion 9 of the wellbore. The direction of this second deviated portion 9 is measured and a signal identifying this direction sent uphole to the surface. To change this direction, the rotation of drill string 17 is stopped, the orientation of the bent sub 30 is set to redirect the drill bit 19 in the desired change of direction, and the rotation of the drill bit 19 continued through only the drill motor 31. This effects a change in the direction of the wellbore from the straight path. When the desired directional change has been completed, as indicated by the measuring-while-drilling system, the rotation of the drill string 21 is restarted.

FIG. 2 illustrates diagrammatically such a change in direction of the second deviated portion 9 of the wellbore. When both the drill string 17 and drill bit 19 are rotated, the borehole follows the direction of the straight path 40 with the borehole size being shown by the dashed lines 42. Preferably, the drill string is rotated at relatively slow speed sufficient to both maintain a straight path and to minimize friction loss from dragging of the drill string along the lower side of the wellbore. Such rotational speed may be in the range of 10 to 25 revolutions per minute, for example. However, slower or faster speeds may also be sufficient. During a change in direction with the bent sub oriented as indicated by the dashed lines 43, the drilling follows the path 41 with the initial borehole size as shown by the dashed lines 44. Following such direction change, the drill string 17 is again rotated and the borehole of the size shown by dashed lines 42 continues in the new direction 41.

An alternative to the use of the bent sub 30 for angularly displacing the axis of rotation of the drill bit 19 from that of the drill string is the use of a bent housing for the drill motor 31. A further alternative is the offsetting of the axis of the drive shaft of the drill motor 31.

Another alternative is the use of non-concentric stabilizers on the drill motor 31.

In high-angle directional drilling, especially for inclinations greater than 60° from the vertical, maintaining the direction and inclination of the wellbore is a difficult, costly, and time-consuming effort. Precision in maintaining close control of high-angle inclination is, therefore, quite important. An increase in only two degrees from an inclination of 80° to 82°, for example, with a 0.1 effective coefficient of friction, can decrease the available bit weight from a drill collar by one-half (from a factor of 0.075 to 0.040). Such control can generally be maintained by a drilling deviation of 1° or less. In one embodiment, as shown in FIG. 3, the bent sub 30 provides a deviation angle of $\frac{1}{4}$° from the vertical axis of the drill string 17 and is in the order of $3\frac{1}{2}$ feet in length.

Maintaining the desired weight on the drill bit 19 in the system shown in FIGS. 1 and 2 is a serious problem is drilling high-angle wellbores. For example, a drill collar, laying in an 80° deviated wellbore with a zero coefficient of friction has only 17% of its weight available for pushing on the drill bit. A 0.2 coefficient of friction might be expected with oil mud on a sliding smooth surface. At this coefficient of friction, the drill collar will not slide from the force of gravity into the 80° wellbore and will not add any weight to the drill bit. The actual apparent coefficient of friction in the axial direction will most likely be greater than 0.2 with a non-rotating drill string, and, by the principle of compound coefficient of friction, be between 0.0 and 0.2 for a rotating drill string. The edges of the non-rotating tool joints and any stabilizers will dig into the wellbore wall, thereby increasing the apparent coefficient of friction in the axial direction. An even greater problem will be maintaining weight-on-bit when directionally drilling with a mud motor without rotation of the drill string since the drill string will provide no weight to the drill bit.

It is, therefore, a specific feature of the present invention to provide a method and apparatus for providing such weight-on-bit when drilling with a mud motor and a stationary drill string. FIG. 3 illustrates such apparatus in detail. Included within a bottom-hole assembly 50 are a drill bit 51, a bent sub 52, a drill motor 53, a measuring-while-drilling sub 54, and an extension sub 55. The extension sub 55 is the immediate source of weight on the drill bit 51. It can be powered by hydraulic pressure, compressed gas, mechanical springs, or the like. Prior to drilling, the extension sub is placed in a contracted position (i.e., compressed) by a rapid dynamic movement downward of the entire drill string by such action as a high-speed rotation, a movement downward from an elevated position, or both simultaneously, until the drill bit 51 strikes the wellbore bottom. On commencement of drilling, the drill bit 51 is advanced or stroked under the weight from the compressed extension sub 55 while the drill string remains stationary. Extension sub 55 may be of the soft spring type or may be of the hydraulic cylinder type wherein pump pressure would cause the extension sub to put weight on the drill bit. For all embodiments of the extension sub, the axial wellbore force reaction to each drilling stroke is the frictional resistance of the drill string against the wellbore wall. Further, it is not necessary that the extension sub 55 be located as shown in FIG. 3. It could be located anywhere along the bottom-hole assembly 50 above the drill bit 51.

At the end of the drilling stroke, when the extension sub 55 is fully extended from its contracted position at the start of the stroke, there is an end-of-stroke indication, for example, a mud pressure increase or decrease. The entire drill string is then drawn up the wellbore and the drill bit 51 repositioned above the wellbore bottom. The procedure is then repeated with the drill string being lowered to compress the extension sub 55 and the drilling stroke being thereafter again completed.

In one example, the drill string is pulled upward until the drill bit 51 is about 30 feet above wellbore bottom. The mud circulation is stopped and the drill string rotation is increased to about 150 rpm. A rapid lowering of the rotating drill string is then initiated to compress the extension sub 55. It is preferred that the compressed extension sub be able to advance the drill bit at least 2 to 4 feet during each drilling stroke with no drill string advancement. This may be accomplished by an extension sub delivering about 20,000 pounds of weight to the drill bit in the compressed state and about 16,000 pounds in the extended state.

In carrying out a drilling operation with the bottom-hole assembly of the present invention it is important that the drill bit be oriented in the proper direction about the axis of the wellbore. It is very difficult to achieve the desired orientation when the entire bottom-hole assembly is simultaneously rotated and rapidly lowered to impact the wellbore bottom with enough force to place the extension sub in a contracted position for effecting weight on the drill bit. To achieve the desired degree of orientation, the bottom-hole assembly is raised a short distance off the wellbore bottom after the extension sub is placed in contraction but before the drill motor is activated and the extension sub is released from its contracted position to effect a drilling stroke. During this raising, the bent sub is rotated to the desired orientation. Thereafter the bottom-hole assembly is lowered into contact with the wellbore bottom. The drilling stroke is now ready to begin by the activation of the drill motor and the release of the extension sub.

Control of this orientation of the bottom-hole assembly is by means of the measuring whole drilling unit 32 in conjunction with a plurality of stabilizers 56. Stabilizers 56 are preferably of the spiral-bladed type. As the bottom-hole assembly is raised off the wellbore bottom, these stabilizers drag along the wellbore wall and affect rotation of the bottom-hole assembly to the desired orientation as measured by the measuring-while-drilling unit. The entire drill string may be rotated along with the bottom-hole assembly by the use of additional stabilizers or a ratchet may be placed at the top of the bottom-hole assembly to permit only rotation of the bottom-hole assembly. The ratchet could be closed and locked with pump pressure. A still further alternative would be to apply reverse torque at the surface to rotate the entire drill string without back-off of any of the tool joints while pulling the bottom-hole assembly upward.

Drill bit 51 is a $12\frac{1}{4}$ inch bit. Drill motor 53 is $7\frac{3}{4}$ inch Delta 1000 mud motor supplied by Dyna-Drill Co. of Irvine, Calif., and which is $24\frac{1}{2}$ feet in length. The measuring-while-drilling system 54 can be of the types supplied by the Analyst/Schlumberger of Houston, Tex.; Gearhart Industries of Fort Worth, Tex.; Teleco Oil Field Services of Meriden, Conn.; or Exploration Logging of Sacramento, Calif., for example. Other suitable measuring-while-drilling systems are disclosed in U.S. Pat. Nos. 3,309,656; 3,739,331; 3,770,006; and 3,789,355. The spiral-bladed stabilizers 56 can be of the integral blade or non-magnetic integral blade type supplied by Norton Christensen, Inc. of Houston, Tex. or of the rig-replaceable sleeve type supplied by Drilco (Div of Smith International) of Houston, Tex., for example.

Several alternative embodiments are available for configuration of the extension sub 32. When powered by hydraulic pressure, the teaching of U.S. Pat. No. 3,105,561 to Kellner for a hydraulic actuated drill collar may be utilized. A servo-controlled hydraulic loading ram is disclosed in Report No. C00-4037-3, Aug. 1, 1977, of the Energy Research and Development Administration in an article entitled, "Downhole Drilling Motors: Technical Review". The technology utilized in conventional bumper subs or jars for drilling and fishing operations may also be used. Such bumper subs include the lubricated bumper sub No. 746-23 of Baker Service Tools, the A-Z fishing bumper sub of A-Z International Tool Co., and the fishing bumper sub described in Technical Manual No. 4460 of Bowen. One such bumper jar is the ball bearing drive bumper jar of Driltrol.

While a preferred embodiment of the invention has been described and illustrated, numerous modifications or alterations may be made without departing from the spirit and scope of the invention as set forth in the appended claims.

What is claimed is:

1. A method of drilling a deviated wellbore into the earth by a rotary drilling technique wherein a drill tool is used to advance a drill bit through the earth and a drilling fluid is circulated down the drill tool and returned from the wellbore in the annulus formed about the drill string, comprising:

(a) drilling a vertical first portion of said wellbore into the earth from a surface location to a kick-off point at about the lower end of said first portion by rotating and advancing said drill tool and drill bit into the earth, (b) initiating a second portion of said wellbore at said kick-off point, (c) withdrawing said drill tool and drill bit from said vertical first portion of said wellbore, (d) running into said vertical first portion of said wellbore a drill tool for drilling said deviated second portion of said wellbore, said drill tool being comprised of a drill string having affixed to its lower end a bottom-hole assembly including a drill bit, a motor for rotating said drill bit independently of said drill string, a bent sub for directing the axis of rotation of said drill bit such that it is angularly displaced from the axis of said drill string, an orientation device for sensing the rotation of said bottom-hole assembly, and an extension sub having both contracted and extended positions for providing weight to said drill bit during movement from said contracted to said extended position, (e) positioning said drill tool such that said drill bit is a predetermined distance above the wellbore bottom, (f) imparting both rotation and a rapid dynamic movement downward to said drill tool such that said drill bit impacts the wellbore bottom and places said extension sub in a contracted position, (g) raising said drill tool so that said drill bit is no longer in contact with the wellbore bottom, (h) rotating said bottom-hole assembly so that the axis of rotation of said drill bit is at a desired angular orientation with respect to the axis of said drill string, (i) producing a drilling stroke of said drill bit into the earth below the wellbore bottom by simultaneously maintaining said drill string stationary, rotating said drill bit under control of said drill motor, and advancing said drill bit under the weight provided by said extension sub in moving from said contracted position to said extended position, and (j) repeating steps (e) through (i) so as to provide additional drilling strokes for the drilling of said deviated wellbore.

2. The method of claim 1 wherein said step of imparting downward movement to said drill tool so as to place said extension sub in a contracted position includes the high-speed rotation of said drill string.

3. The method of claim 2 wherein said drill string is rotated at a speed of at least 150 revolutions per minute.

4. The method of claim 1 wherein said drill tool is positioned in step (e) such that said drill bit is at least 30 feet above the wellbore bottom.

5. The method of claim 1 wherein the step of rotating said bottom-hole assembly is carried out by means of the movement of spiral-bladed stabilizers, affixed to said bottom-hole assembly, against the wellbore wall as said drill tool is raised to move the drill bit out of contact with the wellbore bottom.

6. The method of claim 5 wherein said bottom-hole assembly is rotated by means of said spiral-bladed stabilizers along with said drill string as said drill tool is raised to move the drill bit out of contact with the wellbore bottom.

7. The method of claim 5 wherein said bottom-hole assembly is rotated by means of said spiral-bladed stabilizers independently of said drill string as said drill tool is raised.

8. The method of claim 7 wherein said bottom-hole assembly is rotated independently of said drill string by means of a ratchet which affixes said bottom-hole assembly to the lower end of said drill string.

9. The method of claim 1 wherein said drill tool provides at least 20,000 pounds of weight to said bit in a deviated wellbore of at least 60° from the vertical when said extension sub is released from its contracted position.

10. The method of claim 9 wherein said drill tool provides at least 16,000 pounds of weight to said bit in a deviated wellbore of at least 60° from the vertical when said extension sub is in its extended position.

* * * * *